US005344328A

United States Patent [19]

Suggs

[11] Patent Number: 5,344,328

[45] Date of Patent: Sep. 6, 1994

[54] SPARK PLUG KEEPER

[76] Inventor: Timothy Suggs, 3951 SW. 130 Avenue, Miramar, Fla. 33027

[21] Appl. No.: 82,400

[22] Filed: Jun. 28, 1993

[51] Int. Cl.[5] ..... H01R 13/533

[52] U.S. Cl. ..... 439/127; 123/169 PH

[58] Field of Search ..... 435/125, 127, 128, 471, 435/893; 123/169 PH

[56] References Cited

U.S. PATENT DOCUMENTS

| | | | |
|---|---|---|---|
| 3,720,906 | 3/1973 | Punako et al. | 439/471 X |
| 3,889,909 | 6/1975 | Kosick | 439/471 X |
| 3,965,879 | 6/1976 | Fitzner | 123/169 PH X |

FOREIGN PATENT DOCUMENTS

| | | | |
|---|---|---|---|
| 0113180 | 5/1988 | Japan | 123/169 PH |

*Primary Examiner*—Eugene F. Desmond

*Attorney, Agent, or Firm*—Malloy & Malloy

[57] ABSTRACT

To be utilized to maintain a spark plug in electrical engagement with an electric boot, a spark plug keeper having a ring-shaped base adapted to receive a lower portion of the spark plug therein and to bear against the underside of a hex nut included on the spark plug, the spark plug being in electrical engagement with an interior of a boot. The ring-shaped base further includes at least one upstanding finger which is internally barbed and is made of a flexible material and at its upper end is provided with a cable that is drawn tightly thereabout such that the boot will be maintained in electrical engagement with the spark plug, the ring being formed of a strong, yet flexible material such that the cable will substantially tighten the outstanding fingers, and more particularly the internal barbed surface about the spark plug boot.

8 Claims, 2 Drawing Sheets

SPARK PLUG KEEPER

BACKGROUND OF THE INVENTION

1. Field of the Invention

The present invention relates to a spark plug keeper designed to securely hold a spark plug in place and in electrical engagement under circumstances of high speeds and high vibrations.

2. Summary of the Invention

It has long been known that a boot and spark plug should be protected from the elements such as dust, rain, and the like. To this end, there have been numerous types of shields or screens, such as that shown in U.S. Pat. No. 2,409,732 for a screening device for spark plugs; U.S. Pat. No. 2,468,226 for a shield for spark plugs; and U.S. Pat. No. 2,177,268, again for a shield for spark plugs. In the art, there is found the patent to Murphy, U.S. Pat. No. 2,468,226. This invention provides a shield for the connection of a spark plug and a electrical boot. It differs from the invention as claimed in that there is an annular ring-shaped portion which has an upstanding means which, however, does not bear against the boot and is maintained in tight captivating relation so that the boot is maintained in electrical engagement with the spark plug. Rather in Murphy, U.S. Pat. No. 2,468,226, the annular portion at the base 8 is between the spark plug and the surface into which it is engaged as opposed to threaded engagement with the hex nut portion. There are no tie means, there are no barb means, and there is no provision for maintaining the electrical engagement as claimed. Brown, et al., U.S. Pat. No. 2,409,732, provides a cup-shaped device composed of two which defines a ring portion which engages the under side of the hex nut but which is intended as a screen and does not provide for barbs on the upstanding portion which engage the boot and a tie means which maintains the upstanding portion's barbs in a captivating relationship with a boot. Problems in the past have also involved the difficulties resulting when electrical engagement of the boot of an electrical lead becomes disengaged from the spark plug terminal, thereby leading to a malfunction of a vehicle. This is especially a problem in the field of high performance vehicles, such as racing cars, which necessarily travel at high speeds with continuous significant vibrations.

It is, accordingly, an object of this invention to provide a keeper means for maintaining the electrical engagement of a spark plug with the electrical lead in a conventional electrical boot. The invention, generally speaking, is of an annular portion to be received about a spark plug with an annular portion in abutting engagement with the downwardly facing surface of a hex nut, conventionally found on a spark plug, and wherein the annular portion has upstanding finger means which are internally barbed and are of a flexible material so that, when a tie means is circumposed about the fingers, and drawn tightly squeezing the barbs into the boot, electrical engagement of the boot with the spark plug is assured.

In accordance with this general overall object, the instant invention will now be described on reference to the accompanying drawings wherein several embodiments of the device are illustrated.

BRIEF DESCRIPTION OF THE DRAWINGS

Like reference numerals refer to like parts throughout the several views of the drawings.

DESCRIPTION OF THE PREFERRED EMBODIMENT

Figure 1:
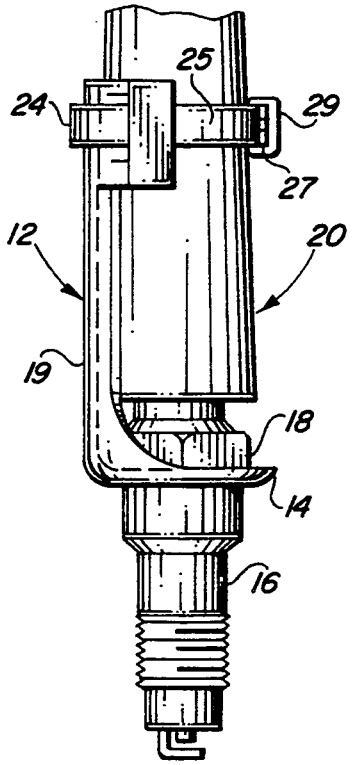
FIG. 1 is a side elevation view illustrating the instant invention in one embodiment comprising a single upstanding leg on a spark plug engaging ring.
Figure 3:
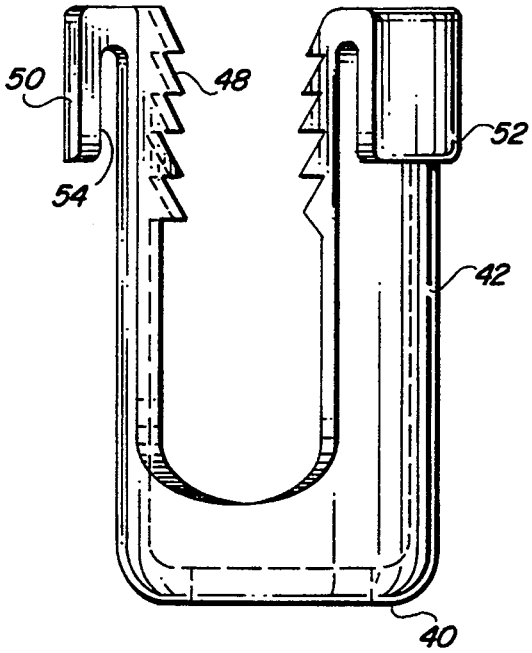
FIG. 3 is a view illustrating a keeper wherein there are three spaced upstanding fingers.

Referring to the drawings and particularly to FIG. 1, there is shown a keeper generally designated by the numeral 12 which is composed of ring means including a ring-shaped base 14 sized to receive the lower portion 16 of a spark plug and to bear against the under side of a hex nut 18, conventionally included on a spark plug. The spark plug is in electrical engagement with the interior of a boot 20. The ring 14 has an upstanding finger 19 which, at its upper end, is provided with a cable 24 which is drawn tightly so that the boot is maintained in electrical engagement with the spark plug.

Figure 2:
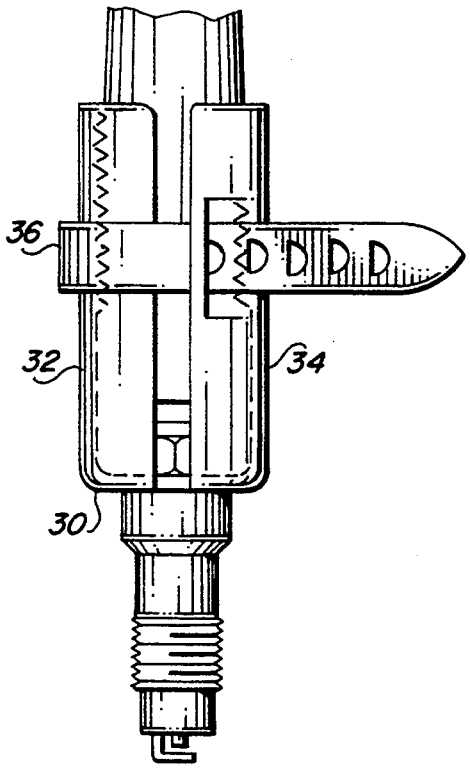
FIG. 2 is a device similar to FIG. 1 with the exception that there are provided two upstanding fingers of substantially semi-circular configurations.
Figure 4:
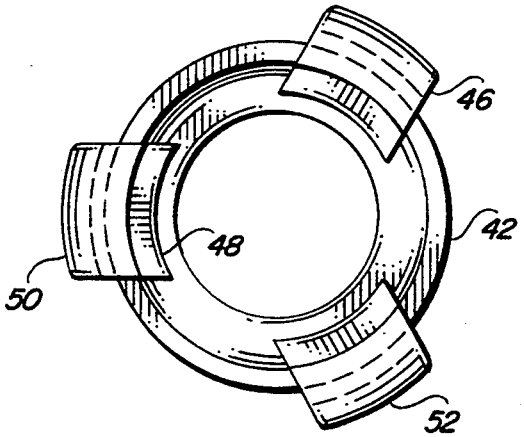
FIG. 4 is a top view of the device shown in FIG. 3.
Figure 5:
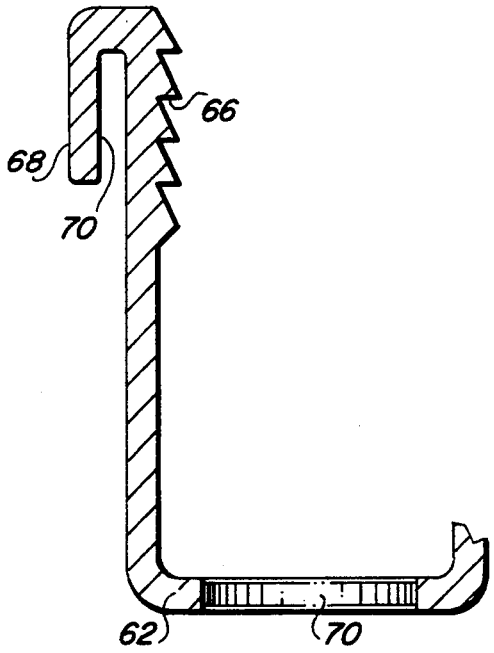
FIG. 5 is a view illustrating the configuration of the upstanding fingers shown singularly in FIG. 1, with two fingers in FIG. 2, and with three fingers in FIG. 3.

FIG. 2 is a device similar to FIG. 1; however, it includes a ring-shaped base 30 with a pair of diametrically opposed arcuately shaped fingers 32 and 34 which are provided with a tie 36.

Figure 6:
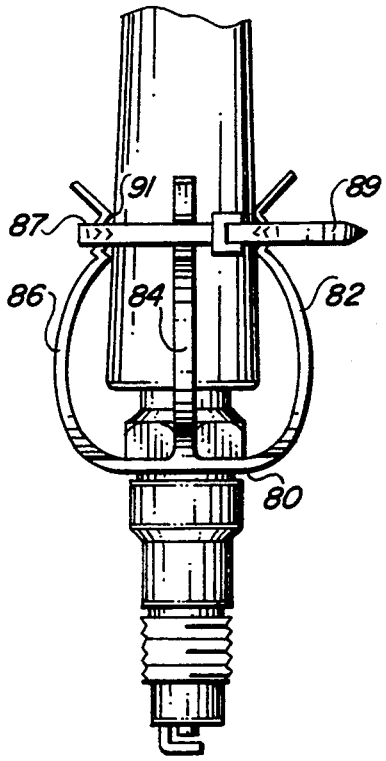
FIG. 6 is an alternative embodiment to that shown in the previous figures and illustrating a plurality of four upstanding fingers on a ring which is circumposed and in abutting engagement with the under side of a hex nut of a spark plug.

In the embodiment shown in FIG. 6, a ring-type base 80 is also provided with four upstanding fingers such as 82, 84, and 86 which are provided with a recess as at 87 so that when the cable tie 89 is tightened as described above, the barbs or teeth such as 91 bite into the boot again maintaining the electrical engagement of the spark plug and the boot.

Figure 7:
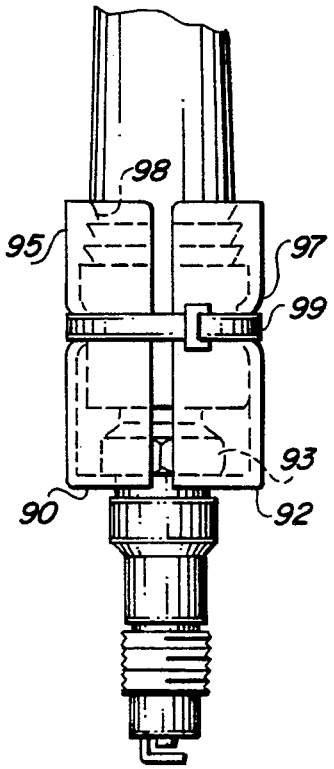
FIG. 7 is an alternative embodiment illustrating two ring portions held together by a keeper.

FIG. 7 is a somewhat modified version in that the ring is composed of two base portions 90 and 92 which are sandwiched about the hex nut 93 conventional in a spark plug and which ring portions have upstanding fingers such as 95 and 97 which at their upper ends are provided with internal barbs as at 98. Once again, a cable tie 99 is utilized as described above to tighten the upstanding portions so that the barbs 90 bite into the boot maintaining the boot into electrical engagement with the spark plug.

Figure 8:
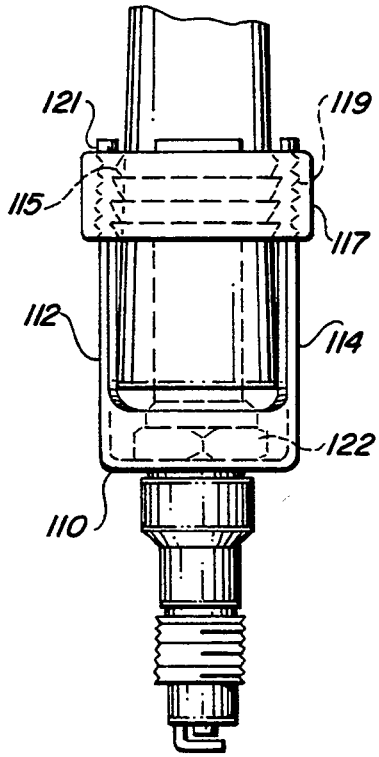
FIG. 8 is a device illustrating a further alternative embodiment.

In FIG. 8, a ring-shaped base 110 is provided with an upstanding finger means in the form of two fingers 112 and 114 wherein the terminal end portions of these fingers 112 and 114 are internally barbed as at 115 and maintained in electrical engagement by means of a retaining nut 117 which is internally threaded to receive external threads provided as at 119 on the upper terminal end 121 of the pair of fingers, so that as the nut is advanced towards the hex nut 122, the barbs bite into the boot, once again maintaining the same in electrical engagement with the spark plug.

It is thus seen that there has been provided a device which, in use, is connected to the under side of the hex nut conventional on spark plugs and the lowermost ring means engages the under side of the hex nut so that when the boot is telescopically positioned and electrical engagement with the spark plug, the upwardly extending fingers may be drawn by a tie means into engagement with the boot and there maintained so that electrical engagement is not broken during heavy use, such as in race cars.

In a preferred embodiment, a cable means or tie means includes an elongate length with exterior recesses and a housing with an internal recess through which the length of the cable means is adapted to be drawn and into which housing there is a tooth means to engage the recesses so that the cable can drawn in one direction only of tightening.

While this invention has been shown and described in what is considered to be practical and preferred embodiments, it is recognized that the concept of a ring means in engagement with the hex nut of a conventional spark plug and upstanding finger means on the base ring provided with barb means to engage the exterior surface of a boot to be drawn by a tie means into squeezing relationship so as to maintain the boot in electrical engagement with the spark plug is the general concept which should therefore not be limited except as set forth in the following claims and within the doctrine of equivalents.

What is claimed is:

1. For maintaining a) a spark plug with a first end and a second end and a hex nut portion between the ends, the hex nut portion having an annular surface facing the second end, b) in electrical engagement with an electric boot having a downwardly opening recess sized to telescopically receive the first end of the spark plug, a keeper, comprising:

a) a ring means sized to slidably receive the spark plug between the annular surface of the spark plug facing said second end of the hex nut and the second end, with the ring means in abutting engagement with the annular hex nut surface facing the second end of said spark plug, b) upstanding finger means on the ring means, said finger means having a first surface to confront the boot and a second exterior surface, said finger means having an upper terminal end, c) barb means on the first surface confronting the boot, and d) tie means to encircle the finger means and the boot and to maintain the finger means and the barb means of the finger means in tight captivating relationship of the boot relative to the spark plug when in electrical engagement one with the other.

2. The device as set forth in claim 1 wherein said finger means comprises a single upstanding member.

3. The device as set forth in claim 1 wherein said finger means comprises a plurality of upstanding confronting portions.

4. The device as set forth in claim 1 wherein recess means are defined wherein said finger means have an upper terminal end and recess means adjacent the upper terminal end and for receiving said tie means.

5. The device as set forth in claim 1 wherein said ring portion includes a pair of generally semi-circular portions each having an upstanding finger means.

6. The device as set forth in claim 1 wherein said finger means comprising four angularly spaced upstanding finger means and said finger means are of spring steel jacketed with an exterior coating of vinyl.

7. The device as set forth in claim 1 wherein said tie means comprises an annular cable tie wrap means.

8. The device as set forth in claim 1 wherein the exterior surface of said finger means is threaded and said tie means includes a threaded retaining nut sized and configured for engagement with the finger means is provided to squeeze the finger means into abutting engagement with a boot.

* * * * *